United States Patent [19]

Soliman

[11] Patent Number: 4,596,526

[45] Date of Patent: Jun. 24, 1986

[54] BATCH COIL ANNEALING FURNACE AND METHOD

[75] Inventor: Mohamed M. Soliman, Worthington, Ohio

[73] Assignee: Worthington Industries, Inc., Columbus, Ohio

[21] Appl. No.: 708,068

[22] Filed: Mar. 4, 1985

[51] Int. Cl.[4] ..... F16K 1/00; C21D 1/06; F27B 9/04; F27B 11/00

[52] U.S. Cl. ..... 432/23; 137/861; 266/256; 432/24; 432/205; 432/206

[58] Field of Search ..... 432/23, 24, 26, 200, 432/205, 206, 254.1, 254.2; 266/256; 137/861, 881

[56] References Cited

U.S. PATENT DOCUMENTS

| | | | |
|---|---|---|---|
| 164,080 | 6/1875 | English | 148/16.5 |
| 1,699,784 | 1/1929 | Fuchs | 266/249 |
| 1,892,112 | 12/1932 | Moore et al. | 432/24 |
| 1,938,306 | 12/1933 | Webb | 432/206 |
| 2,146,760 | 2/1939 | Pearson | 148/203 |
| 2,432,239 | 12/1947 | Hoak | 432/207 |
| 2,485,995 | 10/1949 | Armstrong | 266/263 |
| 2,591,097 | 4/1952 | Pugsley | 266/254 |
| 2,781,188 | 2/1957 | McKeown | 266/251 |
| 2,815,197 | 12/1957 | Blackman | 432/206 |
| 2,834,590 | 5/1958 | Pugh | 432/206 |
| 3,113,766 | 12/1963 | Guigand | 432/199 |
| 3,169,158 | 2/1965 | Wigg | 266/256 |
| 3,199,853 | 8/1965 | Olsen | 432/4 |
| 3,211,590 | 10/1965 | Hazen et al. | 148/16 |
| 3,301,541 | 1/1967 | Ipsen | 266/250 |
| 3,302,939 | 1/1968 | Scharbrough | 266/81 |
| 3,309,073 | 3/1967 | Guingand | 266/254 |
| 3,366,163 | 2/1967 | Scharbrough | 165/1 |
| 3,470,624 | 10/1969 | Plotkowiak | 34/20 |
| 3,519,257 | 7/1970 | Winter et al. | 148/16.5 |
| 3,600,094 | 6/1952 | Cone | 356/342 |
| 3,603,570 | 9/1971 | Galeone | 432/251 |
| 3,778,043 | 12/1973 | Busch et al. | 266/87 |
| 3,832,129 | 8/1974 | Derbyshire et al. | 432/77 |
| 3,850,417 | 11/1974 | Elorza | 266/254 |
| 4,030,712 | 6/1977 | Rogers | 266/252 |
| 4,086,050 | 4/1978 | Luiten et al. | 432/25 |
| 4,167,426 | 9/1979 | Snyder et al. | 148/113 |
| 4,189,129 | 2/1980 | Engelhard | 266/251 |
| 4,191,598 | 3/1980 | Conybear | 148/16.5 |
| 4,310,302 | 1/1982 | Thekdi et al. | 432/205 |
| 4,412,815 | 11/1983 | White et al. | 432/206 |

*Primary Examiner*—John J. Camby

*Attorney, Agent, or Firm*—Fay, Sharpe, Fagan, Minnich & McKee

[57] ABSTRACT

An apparatus for heat treating a work item includes a cover member and a base member on which the cover member is supported. A work space is defined between the base member and the cover member for receiving at least one work item which is positioned therein. A seal member is located between the base member and the cover member for sealing the work space against the entry and exit of gas. A valving system is provided for regulating the entrance and exit of a gas to and from the work space. The valving system is in fluid communication with the work space and includes a relief valve member for allowing the exhaust of the gas from the work space when gas pressure therein exceeds a predetermined limit.

19 Claims, 1 Drawing Figure

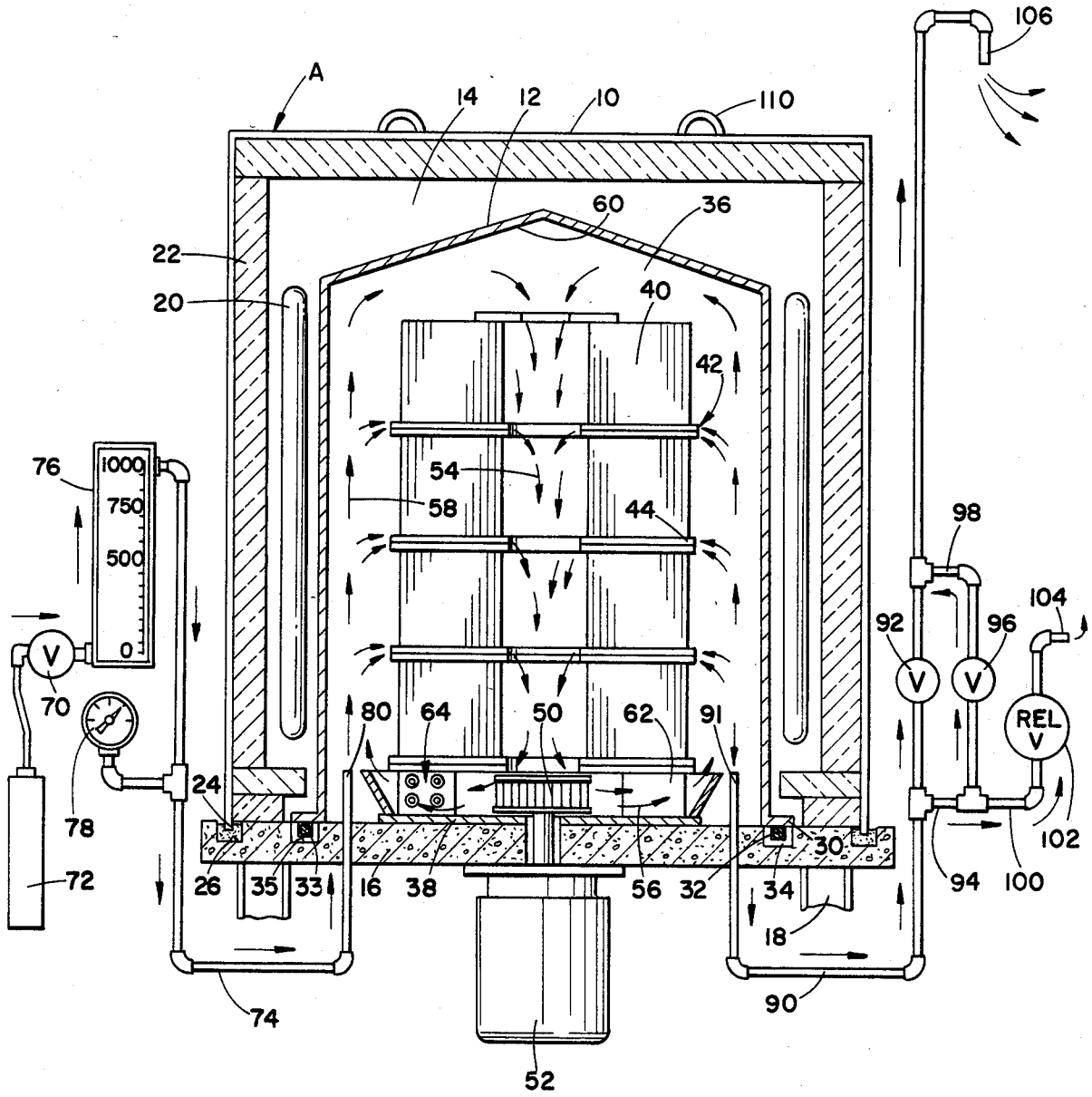
A
14
12
10
110
106
60
36
22
20
40
42
76
1000
750
500
0
54
58
44
98
104
92
96
V
V
V
70
80
64
50
62
91
REL V
24
78
30
102
72
26
35
33
16
38
56
32
34
94
100
18
74
90
52

BATCH COIL ANNEALING FURNACE AND METHOD

BACKGROUND OF THE INVENTION

This invention generally pertains to methods and apparatus for heat treatment. More particularly, the invention relates to batch coil annealing furnaces and a valving system therefor and will be described with particular reference thereto. However, it will be appreciated by those skilled in the art that the invention has broader applications and may generally be applied to valving systems for all types of heat treating operations where at least one work item is placed within an enclosure in a heat transfer relationship with a heating means within the enclosure.

Metals are annealed to reduce their hardness, and improve machinability, facilitate cold working, produce a desired microstructure or to obtain desired mechanical, physical or other properties. When applied to metals, the term "annealing" without qualification implies full annealing which is defined as heating a metal or alloy to its austenitizing temperature and then cooling it slowly through the transformation range under controlled conditions according to a predetermined schedule. There are also many types of partial annealing, such as black annealing, blue annealing, box annealing, bright annealing and so forth.

Annealing of metal strips and the like is generally accomplished by winding the strips into coils having an axial passage bounded by the inner diameter of the winding. Several coils can be stacked on top of one another and enclosed in a sealed inner cover. The inner cover defines a work space and is, itself, enclosed in an outer furnace chamber. Heat is transferred from the outer furnace chamber to the inner cover which, in turn, transfers the heat to the coils. The primary mode of heat transfer from the cover to the coils is by radiation. Additionally, a gas atmosphere is circulated within the inner cover to achieve a more rapid and uniform heat transfer by convection. For proper annealing, a suitable gas atmosphere for annealing has to be maintained within the work space.

The effect of a heat treating operation on the surface condition of workpieces is influenced by the time of heating, the temperature level maintained, and by the atmosphere surrounding the material. By using the proper atmosphere in the working chamber, a clean scale-free surface can be obtained. Such a surface is required for most sheet and strip material and other important products, such as steel wire and tubes. However, some gases, such as oxygen, carbon dioxide and water vapor are very injurious to steel products whereas other gases, such as nitrogen and hydrogen are neutral or even beneficial.

Therefore it is common to use nitrogen, hydrogen or mixtures thereof as a treatment atmosphere during annealing. For example, one common gas mixture which is used for annealing work is composed of 95% nitrogen and 5% hydrogen. Alternatively, a pure nitrogen atmosphere or another nitrogen-hydrogen mixture may be used. Generally, low percentages of hydrogen are used both because hydrogen is quite flammable and because hydrogen is considerably more expensive than nitrogen. Of course, other types of gases, such as methane and the like, can also be used in the treatment atmosphere provided during the annealing process.

One problem with such annealing gases, and particularly nitrogen and hydrogen, is that they are quite expensive to use. During the heating phase of the annealing process, however, the treatment gas atmosphere has to be continuously flushed through the work space. In one conventional process of annealing, a continuous flushing with new gas is also required during the cooling phase since if the gas outlet valve is closed, gas pressure inside the inner cover may become too high due to a pressure build-up caused by a heating of the treatment atmosphere gas by the hot material which is being annealed. If such pressurized gas is not exhausted after being so heated, the inner cover of the furnace would be lifted off its base and begin to float thus mixing the neutral gas atmosphere within the work space with deleterious gases such as oxygen and carbon dioxide.

Accordingly, it has been considered desirable to develop a new and improved coil annealing furnace which would overcome the forgoing difficulties and others while providing better and more advantageous overall results.

BRIEF SUMMARY OF THE INVENTION

In accordance with the present invention, a new and improved coil annealing furnace is provided.

More particularly in accordance with the invention, the apparatus for heat treating a work item includes a cover means and a base means on which the cover means is supported. A work space is defined between the base means and the cover means for receiving at least one work item which is positioned therein. A seal means is located between the base means and the cover means for sealing the work space against the entry and exit of gas. Valve means are provided for regulating the entrance and exit of a gas. The valve means is in fluid communication with the work space and includes a relief valve means for allowing the exhaust of the gas from the work space when gas pressure therein exceeds a predetermined limit.

In accordance with another aspect of the invention, the valve means further comprises a first exhaust valve which is opened when the work space is being heated and a second exhaust valve which is opened when the work space is being cooled.

According to another aspect of the invention, the valve means further includes an inlet valve for controlling the entry of gas into the work space, and a flowmeter positioned downstream of the inlet valve for measuring the amount of gas flowing therepast. A pressure gauge is positioned downstream of the inlet valve for measuring the gas pressure at the inlet valve.

According to a further aspect of the invention, the seal means includes a rubber sealing element and a cooling means therefor. The cooling means preferably includes a box structure which has a cooling fluid flowing therein. The sealing element is preferably positioned in a groove in the box structure.

In accordance with a still further aspect of the invention, the apparatus further comprises circulating means for circulating the gas in the work space.

In accordance with a yet further aspect of the invention, the apparatus further comprises cooling means for cooling the gas before it is recirculated into the work space by the circulating means.

According to still another aspect of the invention, the apparatus further comprises heating means for heating the at least one work item in the work space.

In accordance with yet another aspect of the invention, a plurality of coiled work items are provided in a vertical stack, with each item being separated from each adjoining item by a separator. The separator provides passages between an interior and exterior of each coiled item in the stack so that the gas can circulate therethrough.

According to yet another aspect of the invention, a new method for heat treating a work item is advantageously provided.

One advantage of the present invention is the provision of an annealing furnace which has a relief valve means in communication with a work space to allow for the exhaust of treatment gas from the work space only when gas pressure therein exceeds a predetermined limit.

Another advantage of the present invention is the provision of an annealing furnace in which treatment gas is not exhausted during the cooling cycle, except when gas pressure exceeds a predetermined limit, thereby greatly reducing the amount of treatment gas which is used in the annealing process.

Still another advantage of the present invention is the provision of an annealing furnace having a seal means. The seal means includes a sealing element, which seals the work space at the junction between a base means and a cover means against gas flow, and a cooling means which includes a box structure having a cooling fluid flowing therein. Preferably, the sealing element is positioned in a groove in the box structure.

Still other benefits and advantages of the invention will become apparent to those skilled in the art upon a reading and understanding of the following detailed specification.

BRIEF DESCRIPTION OF THE DRAWING

The invention may take physical form in certain parts and arrangements of parts, a preferred embodiment of which will be described in detail in this specification and illustrated in the accompanying drawing which forms a part hereof, and wherein the FIGURE is a side elevational view in partial cross section of the preferred embodiment of the subject new batch coil annealing furnace and its valving system.

DETAILED DESCRIPTION OF THE PREFERRED EMBODIMENT

Referring now to the drawing wherein the showings are for purposes of illustrating the preferred embodiment of the invention only and not for purposes of limiting same, the FIGURE shows the subject new batch coil annealing furnace A. While the furnace is primarily designed for and will hereinafter be described in connection with batch coil annealing processes, it will be appreciated that the overall inventive concept involved could be adapted for use in other heat treating environments as well.

More specifically, the annealing furnace A includes a heating outer shell or cover 10 used during the heating step and an inner shell or cover 12 defining therebetween a heating chamber 14. The outer and inner covers 10, 12 sit on a base 16 which, in turn, can be supported by a plurality of supports 18 if desired. One or more heating means such as the conventional heat radiating elements 20 are positioned in the heating chamber 14 to heat the furnace. A heat insulating wall covering 22 is provided on the interior walls of the heating step outer cover 10 to restrict the heat from passing therethrough. A foot 24 of the outer cover 10 sits in the trough 26 of the base 16 which trough is filled with a reasonably gas tight material, such as ceramic fiber or the like.

At the lower end of the inner cover 12 is an outwardly turned peripheral flange 30 which sits on the base portion 16. A seal means can be provided between the base 16 and the flange 30. The seal means includes one or more rubber seal strips 32 or the like, which are positioned in a groove 33 of a cooling box 34 which has water or the like flowing therethrough. Water flow may average 4–6 gallons per minute. The cooling box sits in a suitably sized channel 35 provided in the base. The seal strip 32 serves to prevent the entry or exit of gas into a work chamber 36 defined between the inner cover 12 and the base 16.

Positioned in the work chamber 36, and resting on a stand 38 which, in turn, is supported by the base 16, are a plurality of coils 40 of a steel, metallic alloy or a similar material which is to be annealed. The coils 40 are stacked one on top of the other so that they are coaxial and a separator plate 42 preferably separates each coil 40 from each adjacent coil. Passages 44 are provided in each separator plate 42 so that gas can circulate therethrough between an interior and an exterior of each coil 40.

An impeller or a similar suitable conventional fan 50 is advantageously provided beneath the coils 40, and can be mounted inside the stand 38. The fan can be driven by a suitable motor 52 which can be secured to the base 16. Gas inside the inner chamber or work chamber 36 is caused to be circulated by the fan 50 such that an axial flow path 54 leads from the coaxial centers of the coils downwardly to the fan and gas is caused to flow outwardly from the fan in a radial flow path 56 and upwardly back into the work chamber 36. The gas subsequently flows upwardly in a path 58 until it reaches a dome portion 60 of the inner cover 12 where it will again flow down the axial flow path 54. As mentioned, the coils 40 are supported on the support base or stand 38 which can be provided with a plurality of radially extending support ribs, one of which is illustrated at 62, to provide a support for the coils 40. The ribs 62 provide a plurality of radially extending gas passages in the support 38 to allow the gas to freely circulate therethrough. Also, a cooling means 64 such as a plurality of coolant containing tubes may be provided in the base 38 to cool the gas circulating therethrough.

A gas inlet and outlet flow control means or system is also provided. The system includes a gas inlet valve 70 which is used to control the flow of gas from a reservoir 72 into an inlet pipe 74 which leads to the work chamber 36. Preferably, a flowmeter 76 is in fluid contact with the inlet piping or tubing 74 in order that the amount of gas flowing through the inlet tubing can be observed. Also provided is a pressure gauge 78, which may be of the water column type, and which is in fluid contact with the inlet pipe to allow the gas inlet pressure in the system to be determined. An outlet end 80 of the pipe 74 extends above the base 16 to allow gas to flow into the work chamber 36.

An outlet pipe 90 allows gas to be exhausted from the work chamber 36. The pipe 90 has an inlet end 91 extending above the base 16 to allow gas in the work space to flow out therefrom. The ends 80, 91 of the inlet and outlet pipes 74, 90 are preferably positioned on opposing sides of the support 38 to provide for an efficient gas flow. The outlet pipe 90 leads to a first outlet valve 92 generally termed a "heating" valve since gas flows therethrough during the step of heating the coils 40. A branch tube 94 leads from the outlet tube 90 before the heating valve 92 to a second valve 96 generally termed a "cooling" valve since gas conventionally flows therethrough during the step of cooling the coils 40. A return branch 98 leads back from the cooling valve 96 to the outlet pipe 90.

Also coming off the branch tubing 94 is an exhaust branch 100 which leads to a relief valve 102. The relief valve exhausts pressurized gas into the surroundings through a relief port 104. Similarly, an outlet or port 106 is provided at the end of the outlet tubing 90 for venting the spent treatment gas to the atmosphere.

In one conventional method of annealing steel, the work chamber 36, and hence the coils 40, are raised to a temperature of approximately 1350° F. to 1400° F. by the heat radiating elements 20. While the heating operation is going on, an inert gas, such as a nitrogen-hydrogen mixture, is being fed into the work chamber 36 at the rate of approximately 750 cubic feet per hour and exhausted through the heating valve 92 at the same rate. As mentioned, the inert gas may be nitrogen and hydrogen mixture at a 95%–5% ratio. During the heating process, the water column pressure gauge 78 on the inlet pipe 74 reads approximately six inches. In other words, an over-atmospheric pressure is maintained in the work chamber 36 to prevent atmospheric gas from seeping thereinto even despite the seal means 32.

After heating, the coils 40 are cooled down very slowly over a span of approximately 30 to 70 hours. For the cooling process, the heating step outer cover 10 is removed by lifting it up by a pair of eyelets 110. The heating step outer cover is thereupon replaced by a conventional cooling step outer cover or shell of similar size (not illustrated). The cooling step outer cover includes a conventional top mounted fan which draws atmospheric air into the outer cover and past the inner cover 12 thereby cooling same. Since treatment gas is being circulated by the fan 50 inside the work space 36, the coils 40 positioned therein are also cooled.

Air cooling of the inner cover 12, and hence the coils 40, takes place from approximately 1400° F. to approximately 500° F. At this time, a conventional sprinkler-type device, mounted on the cooling step outer cover, will begin to spray the inner cover 12 with water to more quickly cool down the inner cover, and hence the coils 40 positioned in the work chamber 36 to a final temperature of approximately 175° F.

During this cooling process, it is conventional to continue the flow of the inert gas through the work chamber 36 albeit at a lower rate. It is, therefore, conventional to feed gas into the work chamber 36 at approximately 500 cubic feet per hour and to close the heating valve 92 and open the cooling valve 96 which exhausts the gas at the same rate. Such a through-flow of gas during the cooling process is a standard practice to prevent an overheating of the gas in the work chamber 36.

Since the cooling valve 96 exhausts gas at a rate of 500 cubic feet per hour, and since the cooling process takes place for at least 30 hours, it can be seen that a substantial amount of gas (i.e. approximately 15,000 cubic feet) is vented to the atmosphere in this way. Such venting is, however, expensive since on the average, nitrogen gas costs approximately 42 cents per 100 cubic feet and hydrogen costs approximately $1.80 per 100 cubic feet at this time. Therefore, at a rate of 500 cubic feet per hour for the at least 30 hours of cooling necessary for coils on small bases of approximately 60 inches in diameter, and up to 70 hours of cooling utilized for coils on larger bases, it can be seen that a considerable amount of money could be saved if the cooling valve 96 could be closed.

However, with a closure of the valve 96, an over-pressure situation could develop from time to time in the work chamber 36 because the treatment gas therein would be heated by the hot coils 40 and would become over-pressurized. The treatment gas cannot be cooled fast enough to prevent such a situation from occurring at least some of the time. If this were to happen, the inner cover 12, since it is not clamped to the base 16, would be lifted off the base due to the build-up of pressure from the gases in the work chamber and begin to "float". Such a floating of the inner cover 12 would be harmful since it would allow a mixing of the treatment gas atmosphere in the work chamber 36 with air. The inner cover 12 could be lifted by approximately one-eighths of an inch during such floating and would settle back down on the base 16 once the pressures inside and outside the work chamber 36 were equalized. As mentioned, conventional annealing furnaces avoid this problem by continually exhausting treatment gas, but this is quite expensive.

By installing a pressure relief valve in the outlet pipe 90 below the regular outlet valves, i.e. the heating valve 92 and the cooling valve 96, as in the present invention, such over-pressure can be vented even if both outlet valves are closed thereby saving a considerable amount of treatment gas and, hence, money. Preferably, the setting of the relief valve 102 is so adjusted that the valve will relieve excess gas pressure just before the inner cover 12 would lift off the base 16. This setting can be approximately nine inches on the water column pressure gauge 76.

Also, the provision of a relief valve 102 enables the gas pressure to be higher inside the inner cover 12 than is conventionally maintained thereby preventing the inner cover 12 from collapsing due to an under-pressurization in the work space 36 caused by a sudden cooling of the treatment gas therein. As mentioned, the coils 40 are generally cooled down to a temperature of approximately 175° F. in the protective atmosphere. The inner cover 12 can then be removed and the coils 40 exposed to the atmosphere to cool them down to room temperature.

It should be noted that the inlet valve 70 needs to be kept open continuously since additional gas is required to maintain the pressure in the work chamber 36 as the coils 40 therein cool down, and hence the treatment gas therein cools down. Without additional treatment gas, the pressure in the work chamber 36 would decrease which could lead to a collapse of the inner cover 12.

The present invention thus relates to an apparatus for heat treating a work item positioned in a work space, which apparatus includes valve means for regulating the entrance and exit of a treatment gas to and from the work space. The valve means is in fluid communication with the work space and includes a relief valve means for allowing the exhaust of the gas from the work space when gas pressure therein exceeds a predetermined limit. The relief valve means according to the present invention allows the normal gas exhaust valves to be closed thereby saving substantial amounts of gas while allowing over-pressures of the gas in the work space to be exhausted.

The invention has been described with particular reference to a preferred embodiment. Obviously, modifications and alterations will occur to others upon the reading and understanding of this specification. It is intended to include all such modifications and alterations insofar as they come within the scope of the appended claims or the equivalents thereof.

Having thus described the invention, it is now claimed:

1. An apparatus for heat treating a work item, comprising:

a cover means;

a base means on which said cover means is supported, a work space being defined between said base means and cover means for receiving at least one work item which is positioned therein;

a seal means positioned between said base means and said cover means for sealing said work space against the entry and exit of gas; and, exhaust valve means positioned outside said work space for regulating the exit of a treatment gas to the atmosphere, said valve means being in fluid communication with said work space through a pipe and including at least one exhaust valve and a relief valve for allowing the exhaust of said gas from said work space when gas pressure therein exceeds a predetermined limit even when said at least one exhaust valve is closed.

2. The apparatus of claim 1 wherein two exhaust valves are provided:

a first exhaust valve which is adapted to be opened when said work space is being heated; and, a second exhaust valve which is adapted to be opened when said work space is being cooled.

3. The apparatus of claim 2 further comprising:

an inlet valve for controlling the entry of gas into said work space;

a flowmeter positioned downstream of said inlet valve to measure the volume of gas flowing therepast; and, a pressure gauge positioned downstream of said inlet valve to measure the gas pressure in said valve means.

4. The apparatus of claim 1 wherein said seal means includes a rubber sealing element and a cooling means therefor.

5. The apparatus of claim 4 wherein said cooling means includes a fluid-containing box structure which has a fluid flowing therein, and wherein said sealing element is positioned in a groove in said box structure.

6. The apparatus of claim 1 further comprising circulation means for circulating said gas in said work space.

7. The apparatus of claim 6 wherein said apparatus further comprises cooling means for cooling said gas before it is recirculated into said work space by said circulation means.

8. The apparatus of claim 1 further comprising heating means for heating said at least one work item in said work space.

9. The apparatus of claim 1 wherein a plurality of coiled work items are provided in a vertical stack, each item being separated from each adjoining item by a separator which provides passages between an interior and an exterior of each coiled item in said stack, whereby said gas is enabled to circulate therethrough.

10. An apparatus for heat treating coiled items, comprising:

a cover member defining a vertically elongated work space for receiving a stack of superposed coils of material, each having a hollow central space, said coils being in vertical alignment and forming a vertical flue;

a generally horizontally oriented base plate on which the cover member and the stack of coils are supported, said base plate having a center opening in substantial alignment with said flue when said stack of coils is properly positioned on said base plate;

a fan positioned beneath said base plate and in alignment with said flue for circulating a treatment gas through said flue, said base plate center opening and the rest of said word space;

a seal positioned between said cover member and said base plate for sealing said work space against the entry and exit of said treatment gas;

an inlet means for allowing the entry of said treatment gas into said word space, said inlet means including an inlet valve;

an outlet means for allowing the exit of said treatment gas from said work space, said outlet means including at least one outlet valve and wherein said outlet means further comprises a second outlet valve positioned in parallel with said first outlet valve; and, a relief valve in fluid communication with said outlet means for exhausting said treatment gas from said work space when its pressure exceeds a predetermined limit even when said at least one outlet valve is closed.

11. The apparatus of claim 10 wherein said inlet means further comprises an inlet pipe, as well as a flowmeter and a pressure gauge in fluid communication with said inlet pipe.

12. The apparatus of claim 10 further comprising a plurality of convectors one adapted to be inserted between each two coils of material of said stack, said convectors allowing a flow of said gas between said vertical flue and a space on the exterior of each coil of material.

13. The apparatus of claim 10 further comprising:

a cooling box which has a fluid flowing therethrough to cool the seal.

14. The apparatus of claim 10 further comprising a cooling means for cooling said gas before it is returned into said work space by said fan.

15. An apparatus for heat treating a work item, comprising:

a cover member defining a vertically elongated work space for receiving at least one work item which is positioned therein;

a generally horizontally oriented base member on which said cover member and said at least one work item are supported;

a hood member enclosing said cover member and also supported on said base member;

a seal member positioned between said cover member and said base member for sealing said work space against the entry and exit of gas;

an inlet pipe in fluid communication with said work space and a gas reservoir through which pipe a treatment gas in said reservoir can enter said work space;

an inlet valve which regulates the movement of said treatment gas through said inlet pipe;

an outlet pipe in fluid communication with said work space and the atmosphere through which pipe said treatment gas can be exhausted from said work space;

an outlet valve positioned outside said hood member for regulating the movement of said treatment gas through said outlet pipe; and, a relief valve in fluid communication with said outlet pipe and located upstream from said outlet valve but positioned outside said hood member, said relief valve allowing for the exit of said treatment gas from said work space when the pressure therein exceeds a predetermined limit even when said outlet valve is closed.

16. The apparatus of claim 15 further comprising:

a cooling box structure positioned in said base member adjacent said seal member, said box structure having a fluid flowing therethrough to cool the seal member.

17. The apparatus of claim 15 further comprising:

a circulating means for circulating said gas in said work space; and, a cooling means for cooling said gas in said work space.

18. A method for heat treating a work item comprising:

providing a sealed work space in which at least one work item can be received;

providing an outlet valve and a relief valve upstream from said outlet valve, said two valves being positioned outside said work space and being in fluid communication therewith through a pipe;

positioning at least one work item in said work space;

feeding a treatment gas into said work space;

heating said work item while is is surrounded by said treatment gas;

continuously exhausting said treatment gas from said work space through said outlet valve during said step of heating;

subsequently cooling said work item while it is surrounded by said treatment gas;

closing said outlet valve; and, preventing the exhaust of said treatment gas from said work space during said step of cooling unless gas pressure in said work space exceeds a predetermined limit and when it does, allowing the exhaust of said treatment gas through said relief valve.

19. The method of claim 18 further comprising the step of circulating said gas in said work space during said steps of heating and cooling.

* * * * *